United States Patent [19]

Weiner

[11] Patent Number: 4,761,842

[45] Date of Patent: Aug. 9, 1988

[54] INVALID HANDLING DEVICE

[76] Inventor: Rudolf Weiner, Danzinger Strasse 62, 6360 Friedberg, Fed. Rep. of Germany

[21] Appl. No.: 5,771

[22] Filed: Jan. 21, 1987

[30] Foreign Application Priority Data

Jan. 24, 1986 [DE] Fed. Rep. of Germany ..... 3602105
Jun. 2, 1986 [DE] Fed. Rep. of Germany ..... 3618526

[51] Int. Cl.[4] ..... A61G 7/10
[52] U.S. Cl. ..... 5/81 B; 5/86
[58] Field of Search ..... 5/81 R, 81 B, 83, 86, 5/87; 414/921

[56] References Cited

U.S. PATENT DOCUMENTS 3,568,226 3/1971 Mater et al. ..... 5/81 R
3,981,484 9/1976 James ..... 5/81 R
4,571,758 2/1986 Samuelsson ..... 5/86

FOREIGN PATENT DOCUMENTS 813353 5/1959 United Kingdom ..... 5/83

*Primary Examiner*—Alexander Grosz
*Attorney, Agent, or Firm*—Wegner & Bretschneider

[57] ABSTRACT

An invalid handling device has a vertical standard and a slide which is movable along the standard and connectable with a holding device to carry an invalid. This device has a lifting device inside the standard to move the slide. The slide is guided outside the standard. A suspending cable runs from the slide upwards to a return point and from there down to a fixed point. The return point is provided movable in its height by means of the lifting device.

10 Claims, 2 Drawing Sheets

INVALID HANDLING DEVICE

Figure 1:
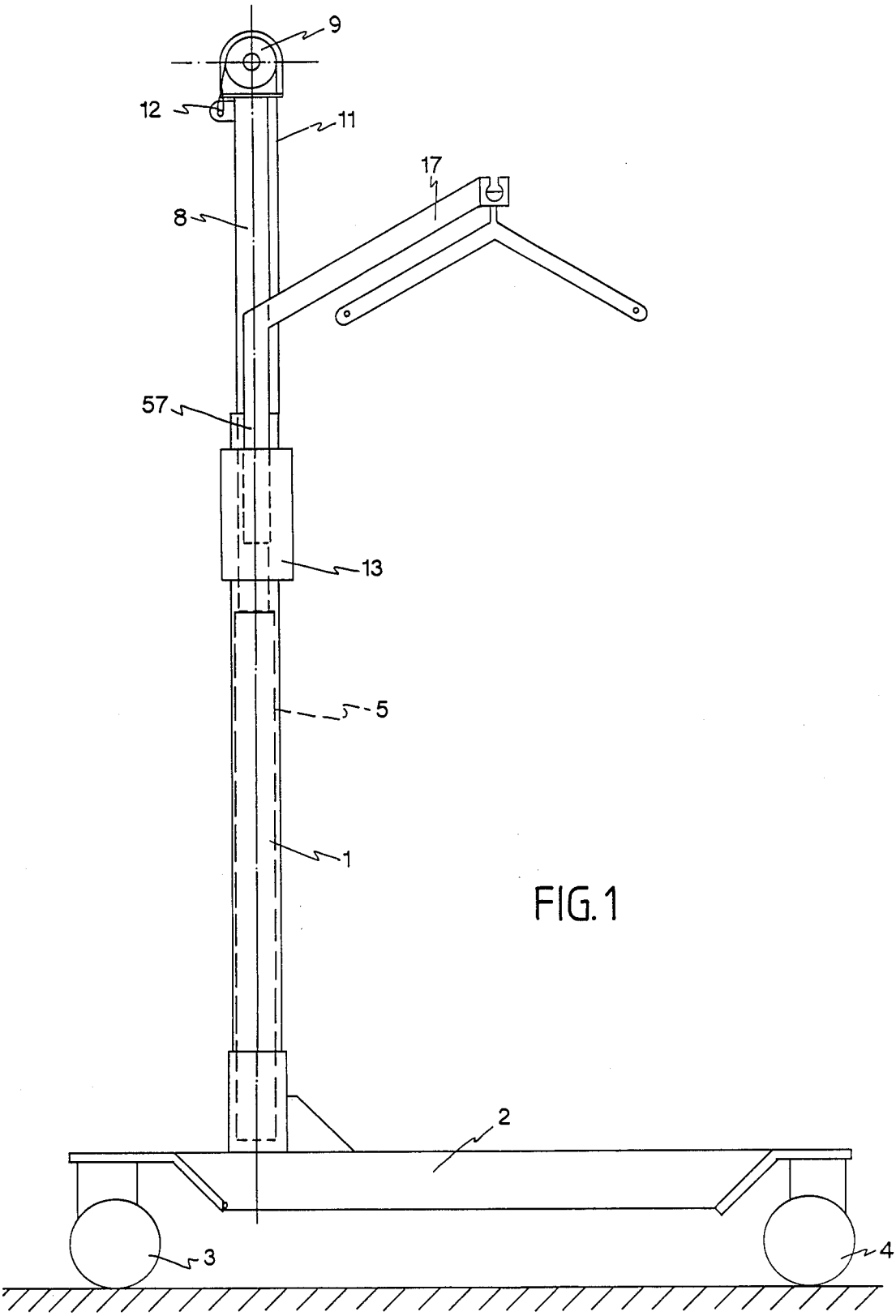

The invention relates to an invalid handling device with a vertical standard and a slide which is movable along the standard and connectable with a holding device to carry the invalid, this device having a lifting device inside the standard to move the slide. Such invalid handling devices are used in hospitals, nursing homes and private homes to carry persons who are partly or completely paralyzed f.i. from the wheel-chair to a bed or into a bath.

To be able to lift invalids from the ground over the edge of a bath, a relatively large stroke is necessary with the invalid handling device. This can be easily achieved by an invalid handling device which has a cantilever being arranged in a swivelling position at which a lift cylinder engages as a lifting device and at the end of which a device to hold the invalid is hung in, because there the lift cylinder is able to engage near the swivel hinge of the cantilever and thus a large swivel angle can be achieved by relatively small strokes. It is also an advantage of devices of this kind that the holding device can be hung in at the end of the cantilever and thus at a relatively high point. This is necessary for textile parts as holding device. A disadvantage of such invalid handling devices is that during transportation the invalid is hung up in a freely swinging position and that he has a relatively large distance from the standard supporting the cantilever if the cantilever is in its lower position. Thereby large bending forces are acting on the standard.

Both disadvantages can be avoided by lifters having the holding device firmly connected with a slide which is movable in its height along a firm standard. The lifting device of such an invalid handling device, however, necessarily must carry out the same stroke as that of the holding device. This leads to difficulties in practice because the height of construction of the lifting device is designated by the minimal height of the slide over the ground which leads to a low height of the lift cylinder and thus an even lower piston stroke. In practice one alleviates this disadvantage by connecting the holding device at different heights with the slide which is movable in its height, so that the available stroke can be higher or lower according to demand. At the known invalid handling devices this shifting of the stroke range, however, has to be effected by a tool, so that it is troublesome.

Apart from this, a disadvantage of the known stroke lifters with a slide is that the standard must have a slot along the whole stroke height, through which reaches a lever of the slide guided in the standard. The invalid handling device is to be fastened to this lever. Invalid handling devices are often used in the sanitary sector, so that water and dirt can easily get into the standard. This leads to a soiling which for hygiene reasons cannot be accepted. Apart from this the slot may cause accidents because during the lifting or lowering of an invalid it is possible that the invalid himself or the person helping him catches his finger in the slot. Furthermore, the slot considerably weakens the bending strength of the standard so that the cross-section of the standard has to be rather large in order to make the standard sufficiently strong.

The object of the invention is to provide an invalid handling device with a slide in such a manner that even with a low stroke of its lifting device a sufficiently large stroke height of the holding device can be achieved, which is less susceptible to soiling and which does not bear the risk of an accident by the possibility of catching a finger.

According to the invention, this object is achieved in that the slide is guided outside the standard, that a suspending cable runs from the slide upwards to a return point and from there down to a fixed point and that the return point is provided movable in its height by means of the lifting device.

By this embodiment the end of the suspending cable which is connected with the slide always moves exactly twice as far up- or downwards as the return point. Thereby the stroke of the holding device is always twice as large as the stroke of the lifting device. Thus a sufficiently large stroke is achieved by usual lift cylinders. Since the slide is not guided inside the standard, as in the prior art, but outside, the standard can be completely closed, so that its interior cannot be soiled and the whole device can be easily cleaned. Also the danger of an accident is much lowered by avoiding a slot in the standard. Due to the absence of a slot a high bending strength of the standard can be achieved, so that even without the unwanted large cross-section the standard does not tend to swing. It is also advantageous that the slide is controlled by the suspending cable only in its movement downwards. If e.g., a lift bath is placed beneath the holding device, the holding device can be lifted by pushing the slide upwards. If the slide were fixed upwards, the invalid handling device would turn over.

As the return point is only maximally extended when the stroke is maximal, the total height normally allows a driving through doors when an invalid is transported and also enables an attending person to look over the standard, if necessary.

An extremely rigid and simple embodiment of the invention is characterized in that the lifting device is a lift cylinder which is arranged in the standard and that the return point is provided at the upper end of a piston rod of the lift cylinder, the piston rod being projecting out of the standard.

The holding device is connectable with the slide as easily and with as little trouble as possible if, according to another embodiment of the invention, the slide has at both sides of the standard a pocket each for inserting one sidewall each of the holding device.

By this embodiment of the fixing means for the holding devices the putting in of the respective holding device is much simplified. The holding devices only have to be inserted with their sidewalls into the pockets which is much easier to be done than the inserting and pivoting of the previous fixing means. Furthermore, at the fixing means according to the invention an incorrect putting in can be noticed at one glance because one can see from all sides of the column whether the sidewalls are inserted sufficiently deep into the pockets. These advantages do not necessitate a higher constructive expenditure than the previously described fixing means, on the contrary, the fixing means according to the invention are easier and thus cheaper than the earlier ones. The simply formed fixing means make it possible to fasten different function parts at the slide so that only one baseframe is necessary for the different function parts. The slide can support f.i. a bed table or an extension device with a Glisson-loop.

Another advantageous embodiment of the invention consists in that the pockets are led vertically and parallel to the standard from above into the slide. Such fixing means offer the advantage that the holding device is not connected with the standard in front of the standard but in alignment with its centre line. Thus the lever arm which stresses the standard by bending is as short as possible, whereby the occurring forces are minimized.

Especially when belt systems are used as holding device it is advantageous if the sidewalls run from the pockets along the standard first upwards and then away from the standard. By this embodiment the suspension place of the holding device gets sufficiently far enough upwards in order to enable the lifting of an invalid f.i. over the edge of a bath. As with the invalid handling device according to the invention the return point anyway goes upwards during an upwards lifting, the height of the device, which results when the upwards lifting is maximal, can also be used for the holding device by the sidewalls of the holding device, which are running along the standard.

The holding device can also support itself at the standard crosswise to its principal direction of extension when the sidewalls each have a spacer above the slide and directed to the standard.

In order to avoid that the invalid handling device is used when the holding device is not completely inserted at least at one side of the slide a latch pin can be provided which locks a sidewall to the pocket.

It is also advantageous if the pockets are provided in a horizontal plane at two sides of the slide. Such pockets can also be provided in addition to the ones mentioned first. In these pockets additional elements can be supported. It is, of course, also possible to fasten holding devices, which are formed accordingly, in the horizontal pockets.

If the horizontal pockets are open at both sides it is possible to push sidewalls through the pockets, so that the width of projection of the elements, which are fastened in the pockets, can be adjusted.

The invention allows numerous embodiments, one of which is shown in the drawing and described hereafter. The drawing shows in FIG. 1 is a side view of an invalid handling device formed according to the invention, FIG. 2 an enlarged sectional representation of a detail which is essential for the invention.

FIG. 1 shows a standard 1 of an invalid handling device. This standard 1 is standing in vertical alignment on a base frame 2 which has wheels 3, 4. A piston rod 8 of a lifting device 5, which is arranged inside the standard 1 can be moved out of the standard 1. On its upper end, this piston rod 8 is provided with a return point 9. A suspending cable 11 is fastened with one end to a fixed point 12 at the top of the standard 1, runs upwards to the return point 9 and then along the other side of the piston rod 8 back downwards to a slide 13 on the standard 1 where the end of the suspending cable 11 is fastened to the slide 13. Thus the slide 13 is movable along the standard 1. Since the cable 11 is arranged in both sides of the slide (i.e., running around the return point 9) and the length of the cable 11 remains constant, if the return point 9 moves upwards, the slide 13 is pulled upwards on the standard 1 by the twice the distance.

The kind of fastening of a holding device 17 to the slide 13 is important to the instant invention. FIG. 1 shows that this holding device 17 is set from above into the slide 13. The fixing means, which are provided for this purpose, can be seen more precisely in FIG. 2. This figure shows part of the standard 1 with the slide 13 which is movable outside the standard 1. On two sides of the standard 1 this slide 13 has pockets 54, 55, which are closed at the bottom. Sidewalls 56, 57 of the holding device 17 are inserted from above into the pockets 54, 55. As shown in FIG. 1 these sidewalls 56, 57 first run along the standard 1 and then bend in order to form the cantilever of the holding device 17. Spacers 58, 59 support the sidewalls 56, 57 at the standard 1, so that the holding device 17 is not subjected to a substantial amount of torsion.

Figure 2:
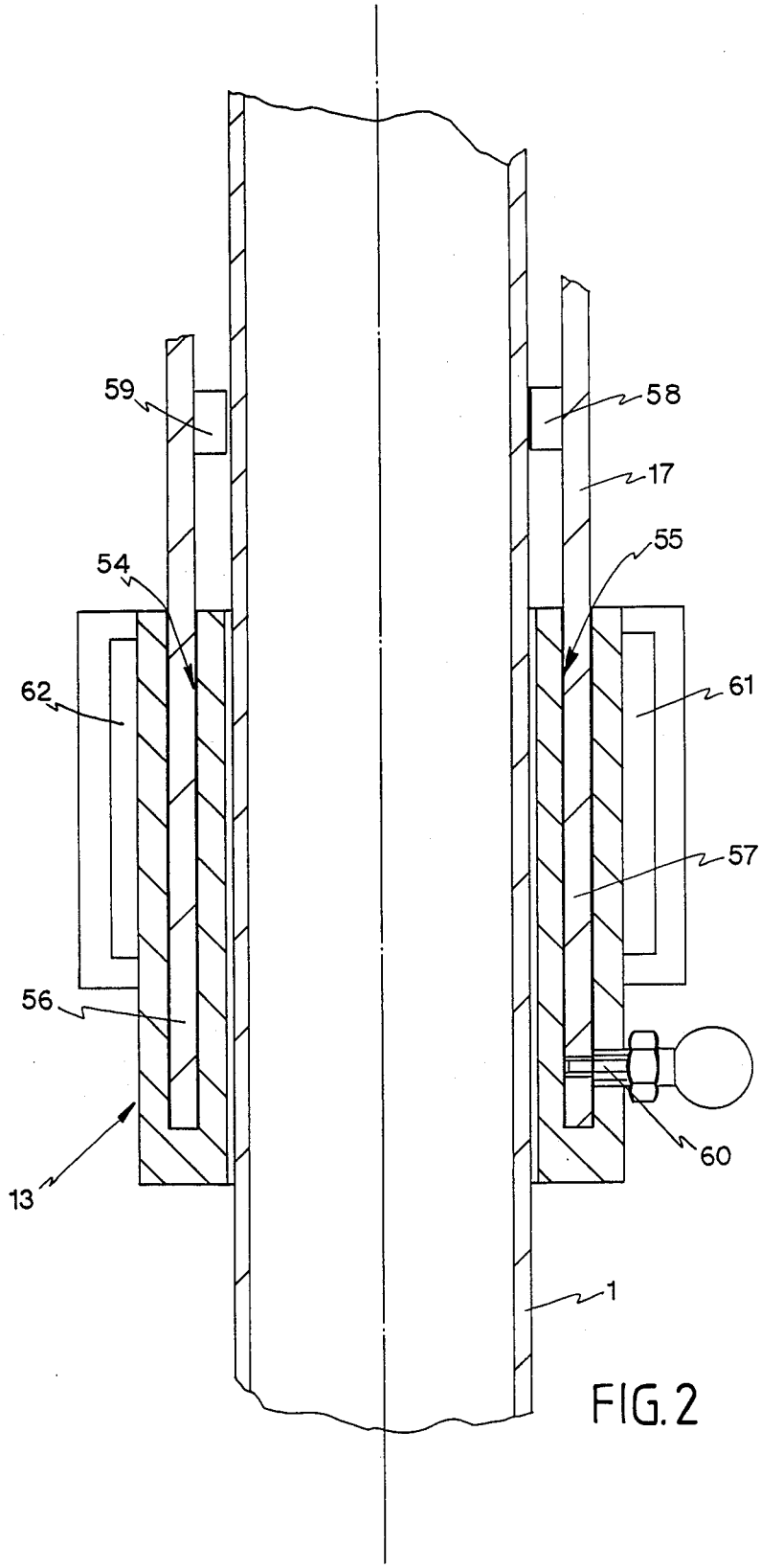

Furthermore, FIG. 2 shows a latch pin 60, which can be inserted into the sidewall 57 and thus locks the holding device 17 when it is completely inserted into the pockets 54, 55 of the slide 13.

Apart from the pockets in vertical alignment described before the invalid handling device can be provided with pockets 61, 62 in horizontal plane. These pockets 61, 62 can either also serve as a mount of holding devices or allow a fastening of additional devices to the slide 13.

While the invention has been particularly shown and described in reference to preferred embodiments thereof, it will be understood by those skilled in the art that changes in form and details made therein without departing from the spirit and scope of the invention.

I claim:

1. An invalid handling device with a vertical standard and a slide which is movable along the standard and connectable with a holding device to carry an invalid, said device comprising a lifting device inside the standard to move the slide, the slide being guided outside the standard (1); and a suspending cable running from the slide upwards to a return point and from there down to a fixed point and wherein the return point is movable relative to the standard by means of the lifting device.

2. The invalid handling device according to claim 1, wherein the lifting device is a lift cylinder which is arranged in the standard and the return point is at the upper end of a piston rod of the lift cylinder, the piston rod projecting out of the standard.

3. The invalid handling device according to claim 1, wherein the slide has at least one pocket at the sides of the standard for receiving sidewalls of the holding device.

4. The invalid handling device according to claim 3, wherein the at least one pocket is vertical and parallel to the standard.

5. Invalid handling device according to claim 4, wherein the sidewalls run from the pockets along the standard first upwards and then away from the standard.

6. The invalid handling device according to claim 3, wherein the sidewalls run from the pockets along the standard first upwards and then away from the standard.

7. The invalid handling device according to, claim 1, wherein each of the sidewalls has a spacer above the slide.

8. The invalid handling device according to, claim 1, wherein a latch pin is provided at least at one side of the slide in order to secure a sidewall into the at least one pocket.

9. The invalid handling device according to claim 1, wherein pockets are provided in a horizontal plane at two sides of the slide.

10. The invalid handling device according to claim 8, wherein the horizontal pockets are open at both sides.

* * * * *